US009295894B2

(12) United States Patent
Papadopolous

(10) Patent No.: US 9,295,894 B2
(45) Date of Patent: Mar. 29, 2016

(54) LIGHT WEIGHT PORTABLE BICYCLE ROLLERS

(71) Applicant: Larry C. Papadopolous, North Plains, OR (US)

(72) Inventor: Larry C. Papadopolous, North Plains, OR (US)

( * ) Notice: Subject to any disclaimer, the term of this patent is extended or adjusted under 35 U.S.C. 154(b) by 87 days.

(21) Appl. No.: 14/080,016

(22) Filed: Nov. 14, 2013

(65) Prior Publication Data

US 2015/0133272 A1 May 14, 2015

(51) Int. Cl.
*A63B 69/16* (2006.01)

(52) U.S. Cl.
CPC ..... *A63B 69/16* (2013.01); *A63B 2069/167* (2013.01); *A63B 2210/58* (2013.01); *A63B 2225/09* (2013.01)

(58) Field of Classification Search
CPC .. A63B 22/0605; A63B 22/02; A63B 21/225; A63B 69/16; A63B 2210/50; A63B 2022/0652; A63B 22/06; A63B 21/015; A63B 2069/165; A63B 2022/0641; A63B 2071/025; A63B 23/0476; A63B 21/0421; A63B 21/0552
USPC ..... 482/51, 54, 57–66; D21/661–664
See application file for complete search history.

(56) References Cited

U.S. PATENT DOCUMENTS

| | | | | |
|---|---|---|---|---|
| 581,835 | A | 5/1897 | Sturgis | |
| 602,546 | A | 4/1898 | Tarver | |
| 604,200 | A | 5/1898 | Vogeler | |
| 2,498,047 | A | 2/1950 | Myers | |
| 2,623,302 | A | 12/1952 | Shields | |
| 2,805,860 | A * | 9/1957 | Littig | 482/61 |
| 3,526,042 | A | 9/1970 | Nelson | |
| 3,686,776 | A | 8/1972 | Dahl | |
| 3,871,648 | A | 3/1975 | Mauer, III | |
| 3,905,597 | A * | 9/1975 | Tabb | 482/61 |
| 4,026,546 | A * | 5/1977 | Omori | 482/61 |
| 4,082,265 | A | 4/1978 | Berkes | |

(Continued)

FOREIGN PATENT DOCUMENTS

| | | |
|---|---|---|
| FR | 23333529 A1 | 7/1977 |
| FR | 2657024 A1 | 7/1991 |

(Continued)

OTHER PUBLICATIONS

Lloyd et ai, "The mechanical efficiency of treadmill running against a horizontal impeding force," J. Physiol., vol. 223, pp. 355-363 (1972).

(Continued)

*Primary Examiner* — Loan H Thanh
*Assistant Examiner* — Andrew S Lo
(74) *Attorney, Agent, or Firm* — Timothy E. Siegel Patent Law, PLLC; Timothy E. Siegel

(57) ABSTRACT

A bicycle rollers device, having a frame that includes a rear mounting assembly for two rear rollers; a front mounting assembly for a front roller; support elements, for supporting the frame above a surface, upon which the support elements are set to rest; and a central bridge connecting the front mounting assembly to the rear mounting gear. Also, two rear rollers are mounted in the rear mounting assembly and a front roller is mounted in the front mounting assembly and defines a roller width. Finally, the central bridge is more narrow than the roller width, thereby permitting a bicycle rider to mount and dismount a bicycle set on the rollers without encountering the central bridge.

11 Claims, 4 Drawing Sheets

(56) References Cited

U.S. PATENT DOCUMENTS

| | | | | | |
|---|---|---|---|---|---|
| 4,352,363 | A | * | 10/1982 | Wilson | 135/96 |
| 4,415,152 | A | | 11/1983 | Smith | |
| D280,225 | S | * | 8/1985 | Eagle | D21/664 |
| 4,580,983 | A | * | 4/1986 | Cassini et al. | 482/61 |
| 4,595,194 | A | * | 6/1986 | Previtali | 482/61 |
| 4,709,917 | A | | 12/1987 | Yang | |
| 4,743,012 | A | * | 5/1988 | Kim | 482/61 |
| 4,750,737 | A | | 6/1988 | Smith | |
| 4,779,863 | A | | 10/1988 | Yang | |
| 4,802,666 | A | | 2/1989 | Rodriqguez | |
| 4,834,363 | A | * | 5/1989 | Sargeant et al. | 482/61 |
| 4,925,183 | A | | 5/1990 | Kim | |
| 4,932,651 | A | | 6/1990 | Defaux | |
| 4,938,475 | A | * | 7/1990 | Sargeant et al. | 482/9 |
| 4,958,832 | A | | 9/1990 | Kim | |
| 4,982,953 | A | * | 1/1991 | Makishi | 482/61 |
| 5,010,763 | A | | 4/1991 | Schneider | |
| 5,042,795 | A | * | 8/1991 | Bursik | 482/61 |
| 5,076,792 | A | | 12/1991 | Niermann | |
| 5,100,127 | A | | 3/1992 | Melnick et al. | |
| 5,205,800 | A | | 4/1993 | Grant | |
| 5,240,417 | A | | 8/1993 | Smithson et al. | |
| 5,314,391 | A | | 5/1994 | Potash et al. | |
| 5,364,271 | A | | 11/1994 | Aknin et al. | |
| 5,385,519 | A | | 1/1995 | Hsu et al. | |
| 5,492,516 | A | | 2/1996 | Trotter | |
| 5,662,559 | A | | 9/1997 | Vasquez | |
| 5,800,314 | A | | 9/1998 | Sakakibara et al. | |
| 5,919,119 | A | | 7/1999 | Bohmer et al. | |
| 6,004,243 | A | | 12/1999 | Ewert | |
| 6,056,672 | A | | 5/2000 | Carbonell Tendero | |
| 6,123,547 | A | | 9/2000 | Teresi | |
| 6,123,647 | A | | 9/2000 | Mitchell | |
| 6,126,571 | A | | 10/2000 | Parks | |
| 6,126,575 | A | | 10/2000 | Wang | |
| 6,135,924 | A | | 10/2000 | Gibbs et al. | |
| 6,394,239 | B1 | | 5/2002 | Carlson | |
| 6,416,444 | B1 | | 7/2002 | Lim et al. | |
| 6,447,424 | B1 | | 9/2002 | Ashby et al. | |
| 6,454,679 | B1 | | 9/2002 | Radow | |
| 6,500,098 | B1 | | 12/2002 | Werner | |
| 6,716,106 | B2 | | 4/2004 | Wang et al. | |
| 6,837,830 | B2 | | 1/2005 | Eldridge | |
| 6,857,992 | B1 | | 2/2005 | Kolda et al. | |
| 7,060,009 | B2 | | 6/2006 | Greenleaf | |
| 7,220,219 | B2 | | 5/2007 | Papadopoulos et al. | |
| 7,942,790 | B2 | * | 5/2011 | Papadopoulos | 482/61 |
| 2002/0055422 | A1 | | 5/2002 | Airmet et al. | |
| 2004/0053751 | A1 | | 3/2004 | Pizolato | |
| 2004/0077465 | A1 | | 4/2004 | Schmidt | |
| 2004/0198562 | A1 | * | 10/2004 | Greenleaf | 482/61 |
| 2005/0164843 | A1 | | 7/2005 | Papadopoulos et al. | |
| 2005/0209064 | A1 | | 9/2005 | Peterson et al. | |
| 2005/0221960 | A1 | * | 10/2005 | Miyamaru et al. | 482/57 |
| 2006/0217237 | A1 | | 9/2006 | Rhodes et al. | |
| 2007/0060453 | A1 | * | 3/2007 | Papadopoulos | 482/61 |
| 2007/0099768 | A1 | * | 5/2007 | Comair et al. | 482/61 |
| 2007/0202998 | A1 | * | 8/2007 | Wan | 482/61 |
| 2009/0264261 | A1 | | 10/2009 | Papadopoulos | |
| 2010/0234188 | A1 | * | 9/2010 | Wan | 482/61 |
| 2011/0287901 | A1 | * | 11/2011 | Wan | 482/57 |

FOREIGN PATENT DOCUMENTS

| | | | |
|---|---|---|---|
| NZ | WO9423807 | A1 | 10/1994 |
| SU | 1319881 | A2 | 6/1987 |
| WO | 0136055 | A1 | 5/2001 |
| WO | WO2005035072 | A1 | 4/2005 |
| WO | WO2007/033254 | A3 | 11/2007 |

OTHER PUBLICATIONS

Christensen et ai, "Inertial-Force Feedback for the Treadport Locomotion Interface", Presence, vol. 9, No. 1, pp. 1-14 (Feb. 2000).

* cited by examiner

LIGHT WEIGHT PORTABLE BICYCLE ROLLERS

BACKGROUND

Bicycle rollers are well known devices for supporting a bicycle and permitting a user to mount and ride the bicycle with the rear wheel rotatably supported by a pair of rear rollers and the front wheel rotatably supported by a single front roller. Motion permitting bicycle rollers include the above described device mounted on wheels or some other motion permitting assembly, so that the rollers and bicycle can move slightly forward and rearward during use, limited by a motion-resisting assembly. To provide a realistic riding sensation, the motion-resisting assembly must permit from 5 to 10 cm of forward and rearward movement, gently resisted and urged back to a center point. To achieve this goal, some currently available systems include an outer frame, which provides a stationary track for movement and an anchor point for one or more elastic members ("bungies") which gently resist the movement. This produces a far more realistic sensation of bicycle riding. Also, however, it is virtually impossible to build an easily collapsible assembly, using this basic structure, because of the two frames.

Whether motion permitting or not, currently available bicycle rollers connect the front roller and rear rollers with a pair of structural rails running along the sides of the rollers about 15 cm off the ground, suspending the rollers above the ground and carrying the weight of the cyclist. Accordingly, these rails present a trip hazard to the user mounting or dismounting from a bicycle mounted on the rollers. When a rider loses his balance and must dismount very quickly, these rails present a particular hazard.

With respect to motion permitting rollers, the current designs tend to be somewhat heavier than would be ideally desirable, and are not collapsible, for easy transport.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a bicycle rollers device, having a frame that includes a rear mounting assembly for two rear rollers; a front mounting assembly for a front roller; support elements, for supporting the frame above a surface, upon which the support elements are set to rest; and a central bridge connecting the front drum assembly to the rear drum assembly. Also, two rear rollers are mounted in the rear mounting assembly and a front roller is mounted in the front mounting assembly and defines a roller width. Finally, the central bridge is more narrow than the roller width, thereby permitting a bicycle rider to mount and dismount a bicycle set on the rollers without encountering the central bridge.

In a second separate aspect, the present invention may take the form of a bicycle rollers device, having a frame that includes a rear roller mounting assembly for two rear rollers; a front roller mounting assembly for a front roller; and a central bridge assembly connecting the front mounting assembly to the rear mounting gear. Also, two rear rollers are mounted in the rear mounting assembly, and a front roller is mounted in the front mounting assembly, each of the rollers having an axis of rotation. Finally, a set of wheels, each rotatably mounted on the roller axles, so as to support the rollers above a surface upon which the wheels are set, the wheels permitting forward and rearward motion of the support assembly and all six of the wheels having an axis of rotation co-incident with the roller axes of rotation.

In a third separate aspect, the present invention may take the form of a bicycle rollers device, having a frame that includes a rear roller mounting assembly for two rear rollers; a front roller mounting assembly for a front roller; and a central bridge assembly connecting the front mounting assembly to the rear mounting gear. Also, two rear rollers are mounted in the rear mounting assembly, and a front roller is mounted in the front mounting assembly and a set of wheels are mounted on the roller axles so as to support the rollers above a surface upon which the wheels are set, the wheels permitting forward and rearward motion of the support assembly. Finally, a motion-resisting assembly, includes one of the set of wheels, which is a motion-resisting wheel, having a wheel attachment element displaced from the axis of rotation, a frame attachment element on the frame, and an elastic tension member, which is attached to the frame attachment element and the wheel attachment element, wherein the motion-resisting wheel has a centered position in which the elastic tension member is at its shortest and wherein when the motion-resisting wheel rotates from the centered position the elastic tension member urges it toward its centered position.

In addition to the exemplary aspects and embodiments described above, further aspects and embodiments will become apparent by reference to the drawings and by study of the following detailed descriptions.

Exemplary embodiments are illustrated in referenced drawings. It is intended that the embodiments and figures disclosed herein are to be considered illustrative rather than restrictive.

DETAILED DESCRIPTION

Figure 1:
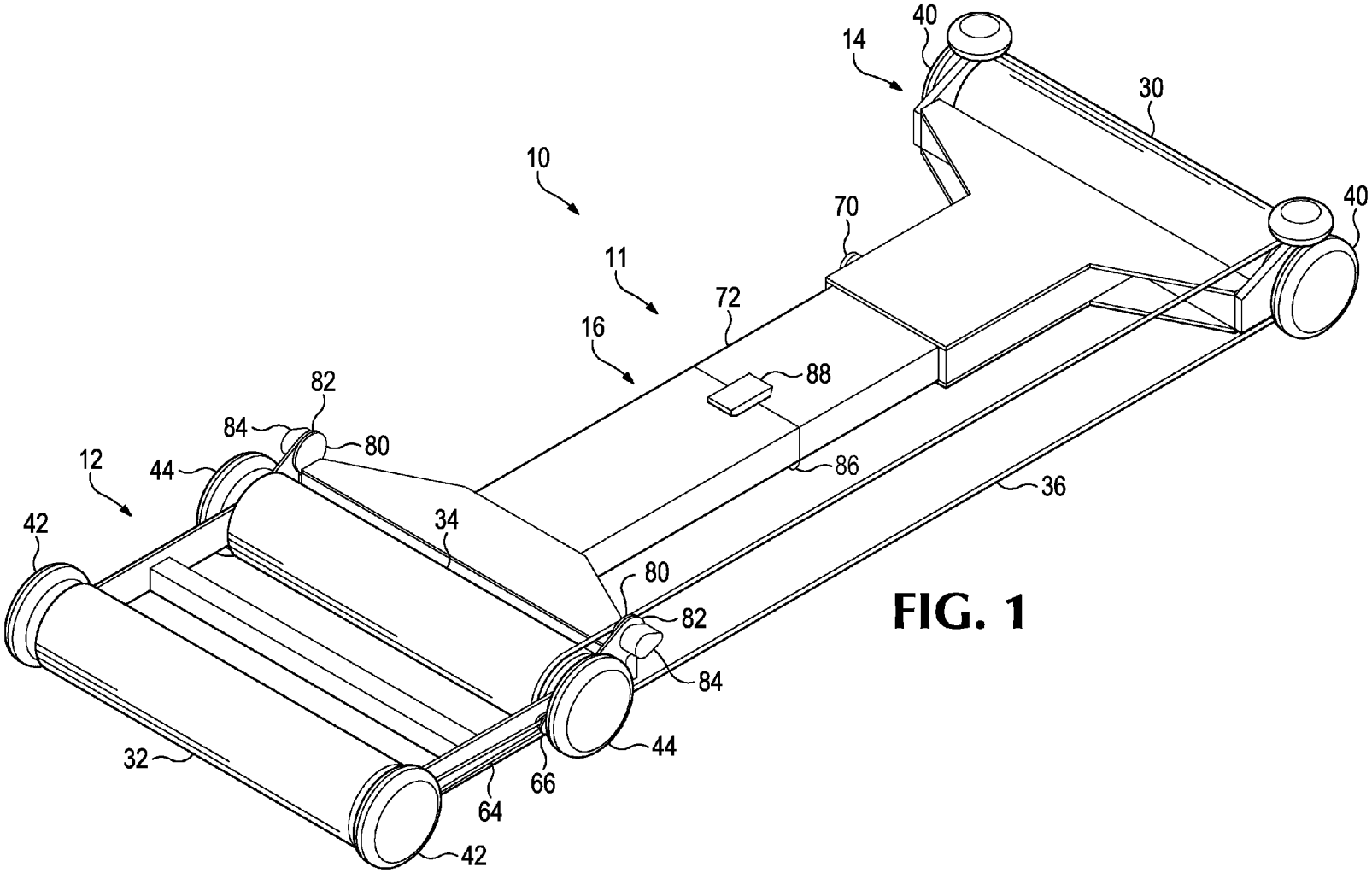
FIG. 1 is a top-side perspective of a bicycle rollers device, according to a preferred embodiment of the present invention.
Figure 2:
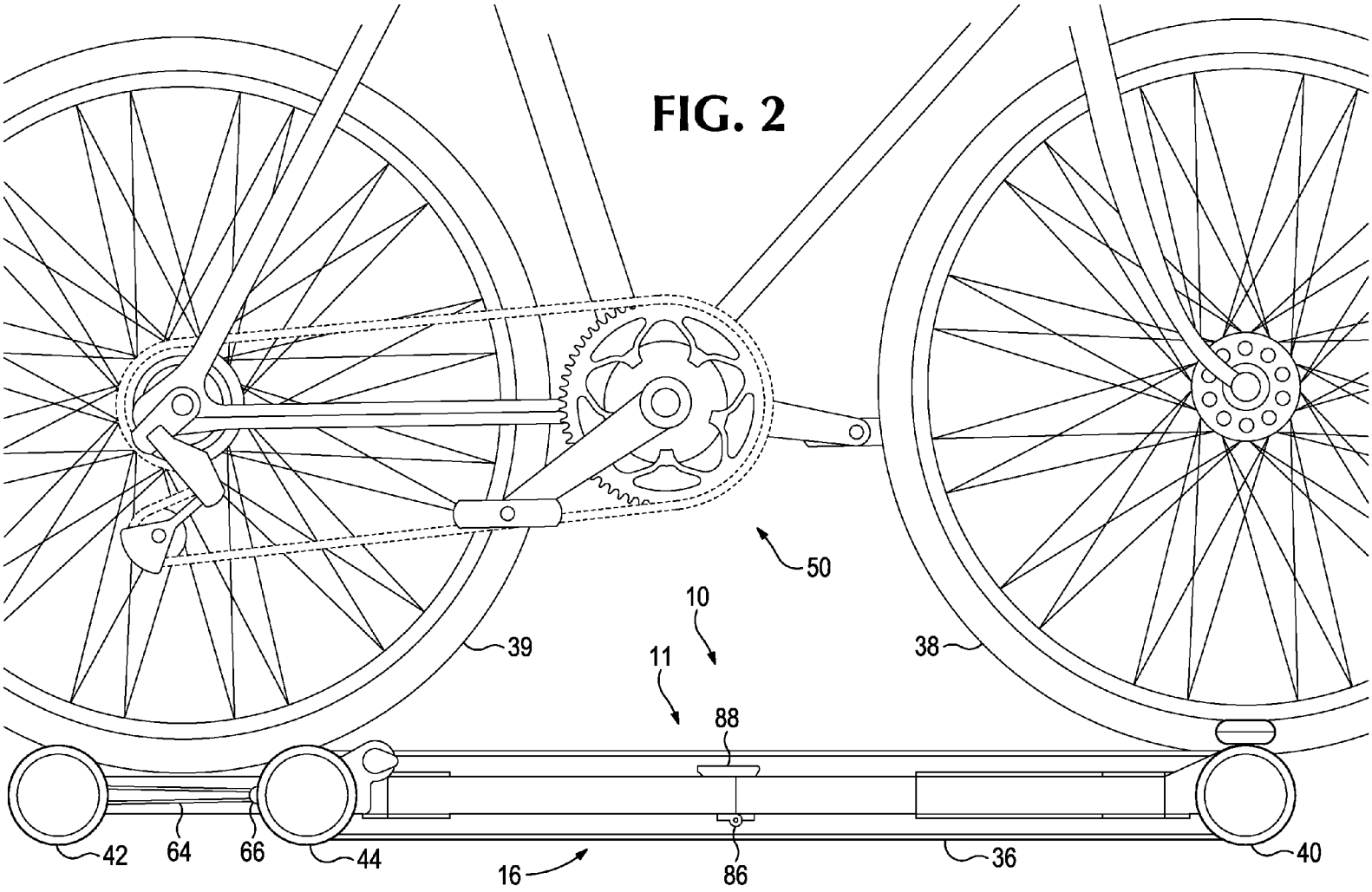
FIG. 2 is a side view of the bicycle rollers device of FIG. 1, showing a bicycle mounted thereto.

Referring to FIGS. 1 and 2, in a preferred embodiment of a bicycle rollers device 10, a frame 11, includes a rear roller mounting assembly 12 and a front roller mounting assembly 14, joined together by a bridge 16. A front roller 30 is rotatably mounted in front assembly 14 and a rearmost roller 32 and forward rear roller 34 are mounted in rear assembly 12. A belt 36 transfers the motion of forward rear roller 34 to front roller 30, so that a front wheel 38 of a bicycle 50 (FIG. 2) rotates and provides a gyroscopic effect when the rear bicycle wheel 39 (FIG. 2) is driven by a rider, as happens when a bicycle is ridden along a road. Also, the axis of the front wheels 40 are mounted onto front mounting assembly 14, in alignment with the axis of rotation of front roller 30. Also, rearmost wheels 42 and forward rear wheels 44 are mounted on rear mounting assembly 12, with the axis of rotation of the rearmost wheels 42 aligned with the axis of rotation of the rearmost roller 32 and the axis of rotation of the forward rear wheels 44 aligned with the axis of rotation of the forward rear roller 34. As a result of this alignment, the rear assembly 12 and front assembly 14 don't have to bear a downward force from a roller, such as roller 30, 32 or 34 at a point not directly supported by a wheel, such as 40, 42 and 44. The transfer of force from a roller to a ground support in other systems required comparatively stronger and therefore heavier elements. Ina preferred embodiment the bridge 16 is made of lightweight polymeric material, thereby resulting in a much lighter overall device 10. This is made possible because no vertical load is shifted through bridge 16, from a roller to a support. As shown in FIG. 2, a bicycle may be placed on device 10.

Figure 3:
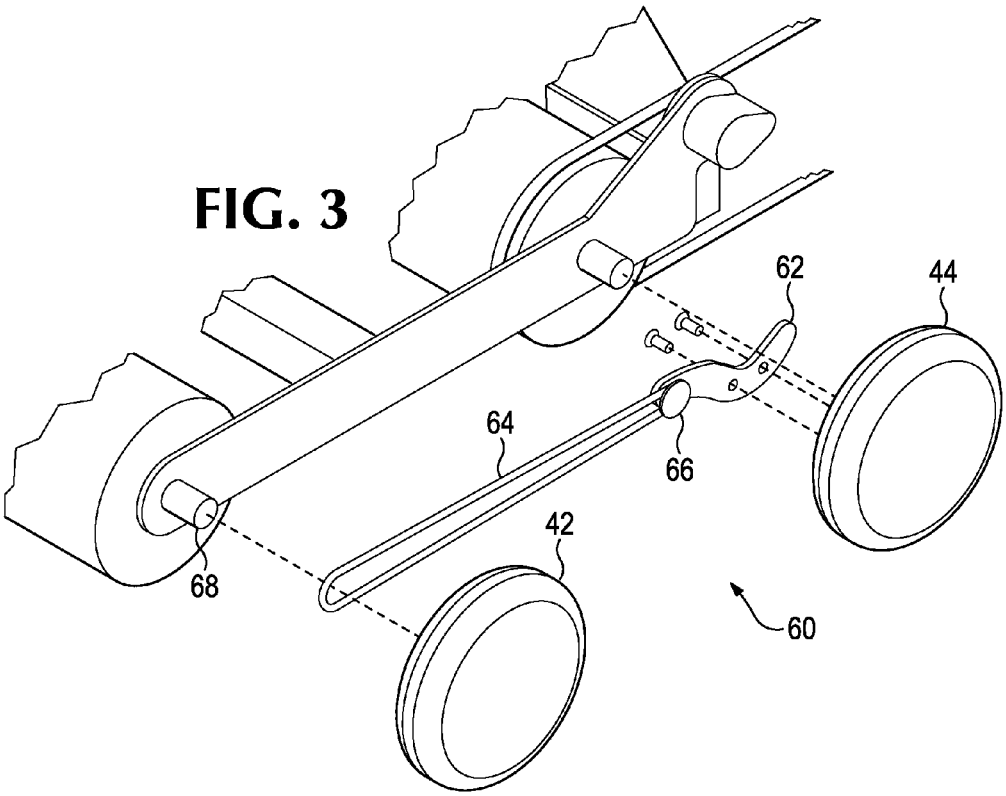
FIG. 3 is an exploded perspective view of a rear portion of the device of FIG. 1, showing a motion-resisting assembly.
Figure 4:
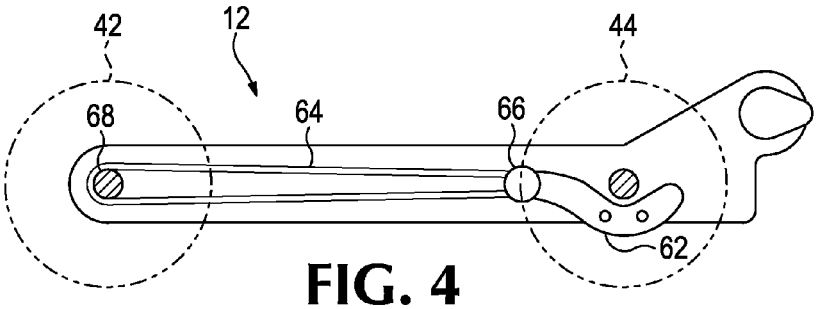
FIG. 4 is a side view of the rear portion of FIG. 3, showing the motion-resisting assembly, at the center of the range of motion.
Figure 5:
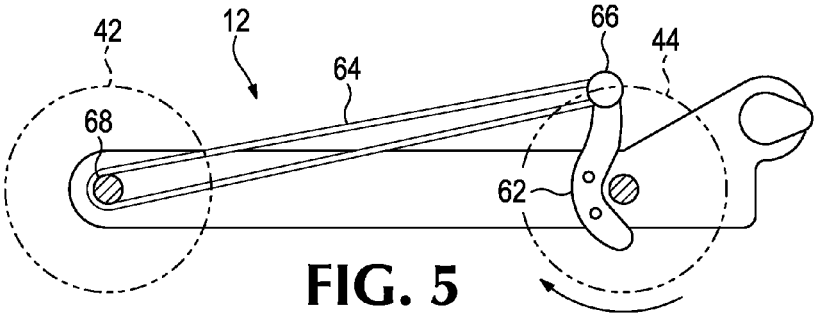
FIG. 5 is the side view of FIG. 4, showing the motion-resisting assembly at an extreme position of its range of motion.

Referring to FIGS. 3-5 a motion-resisting assembly 60, restricts movement of device 10 to a range on the order of +10 cm, so that device 10 can be placed in a limited space, for example a room, without fear of contacting any of the boundaries of the space, for example walls. A rigid arm 62 is attached, off center, to a wheel 44 and supports a wheel attachment element 66, in the form of a post. Also, rear mounting assembly 12, supports a frame attachment element 68 in the form of a stationary axle, about which one of wheels 42 is rotatably mounted. An elastic tension member 64 in the form of an elastic loop is attached to the wheel attachment element 66 and the frame attachment element 68. Wheel 44 has a centered position (shown in FIGS. 3 and 4), in which tension member 64 is stretched the least possible amount. When wheels 44 is rotated away from this center position (FIG. 5), tension member 64 is stretched further, thereby applying force to attachment element 66 which urges wheel 44 back to its center position. In one embodiment, assembly 60 is mounted on only one side of device 10, in another embodiment an identical assembly 60 is mounted on both sides. Skilled persons will recognize that attachment elements 66 and 68 may take many forms. For example, elements 66 and 68 could both be apertures, with elastic member 64 threaded through both of them and having enlarged ends, to prevent becoming disengaged. In another preferred embodiment, element 66 may be a post terminating in a knob that retains elastic member 64. Attachment element 68 could be a post that does not serve as an axle to a wheel. Alternatively, it could be a vertically oriented bridge or bracket, through which member 64 is threaded. Tension member 64 is preferably made of polyurethane, which has advantageous elastic properties, so that elastic tension member 64, when made of polyurethane, behaves as a damped spring. In an alternative preferred embodiment, a compression spring is used instead of tension member 64, and is attached to wheel 44 support assembly attachment element, so that at the centered position of wheel 44, the compression spring is at its maximum length.

Figure 8:
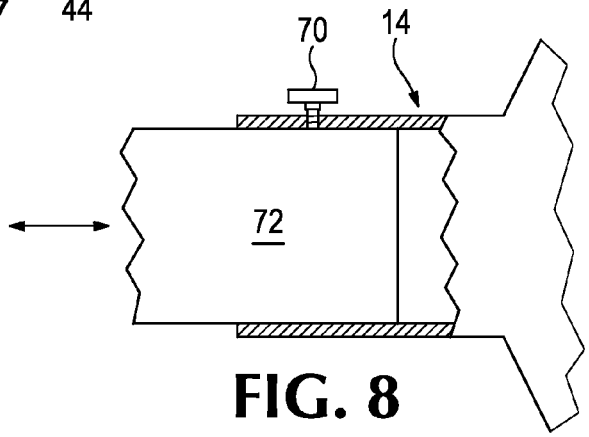
FIG. 8 is a detail view of a telescoping portion of the device of FIG. 1.

Referring to FIGS. 1 and 8 a threaded clamp 70 is mated with a matching hole in assembly 14, so that when post 70 is tightened into hinged central column 72 (which forms a portion of bridge 16), it retains column 72 in relation to assembly 14. When post 70 is loosened away from column 72, column 72 may be adjusted in relationship to assembly 14, thereby permitting the accommodation of different sized bicycles.

Figure 6:
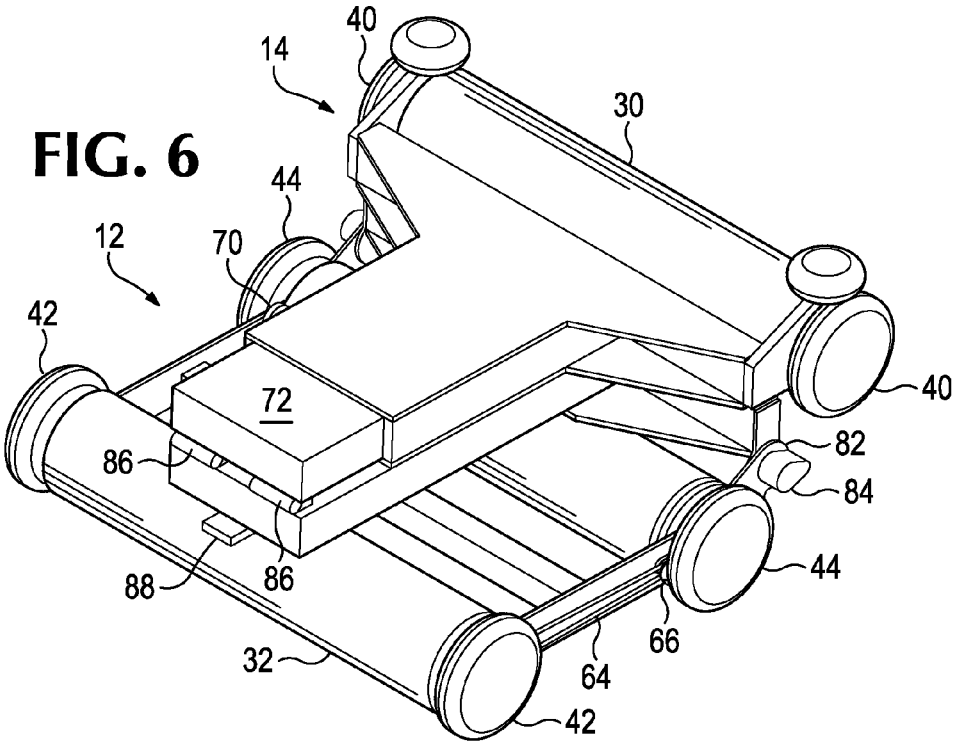
FIG. 6 is a perspective view of the device of FIG. 1, shown in its telescoped in, and folded configuration, for portability.
Figure 7:
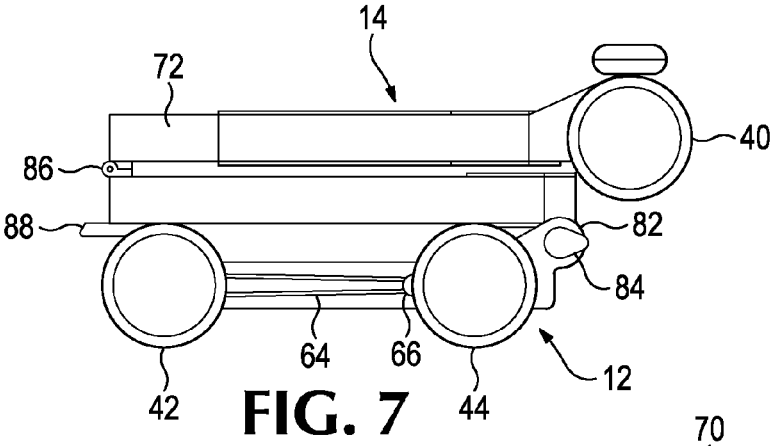
FIG. 7 is a side view of the configuration of FIG. 6.

The folding of device 10 from the configuration shown in FIG. 1, to that shown in FIG. 6 is, in part, made possible by the rotatable attachment of bridge 16 (reference number shown in FIG.1) to rear assembly 12. A pair of ears 80 projecting upwardly from the rear of bridge 16 are rotatably mounted to a pair of projections 82. Referring to FIG. 6, bridge 16 (reference number shown in FIG.1) and assembly 14 are rotated about projections 82, to cover assembly 12. A pair of locking pins 84 are provided to lock assembly 12 and bridge 16 in this position or in the position shown in FIG. 1, with over-rotation of hinge 86 being resisted by plate 88. Next assembly 14 is rotated about hinge 86, to arrive at the configuration shown in FIGS. 6 and 7. Elastic loop 64 may be easily disengaged from post 66 to permit device 10 to be wheeled to a desired location, on wheels 42 and 44.

Central column 72 is made of rectangular polyvinyl tube 14 cm×3.8 cm in transverse dimension, having wall thickness of 2.3 mm. The remainder of the frame 11 is made of either aluminum or steel. In one embodiment the entire device 10 has a mass of less than 8 kg. In an alternative embodiment device 10 has a mass of less than 9 kg. And in yet another alternative, device 10 has a mass of less than 10 kg.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

I claim:

1. A bicycle rollers device, having a front and a back and comprising:

(a) a frame including:

(i) a rear roller mounting assembly for two rear rollers;

(ii) a front roller mounting assembly for a front roller; and (iii) a central bridge assembly connecting said front roller mounting assembly to said rear roller mounting assembly;

(b) two rear rollers mounted in said rear roller mounting assembly, and a front roller mounted in said front roller mounting assembly, each of said rollers having an axis of rotation, and wherein all of said axes of rotation are parallel to one another; and (c) a first support assembly, located about said axes of rotation of said rear rollers and able to support said rear roller mounting assembly above an upwardly facing surface;

(d) a second support assembly, located about said axis of rotation of said front roller and able to support said front roller mounting assembly above the upwardly facing surface; and (e) wherein when said device is in use said first and second support assemblies support said rear and front roller mounting assemblies and weight said rear and front roller mounting assemblies are supporting, above the upwardly facing surface, leaving said central bridge assembly substantially free of vertical structural stress;

(f) wherein said second support assembly comprises a wheel mounted on an axle attached to said frame, and wherein said axle is substantially aligned to said axis of said front roller so that said wheel has an axis of rotation that is parallel to the axis of rotation of said front roller.

2. A bicycle rollers device, having a front and a back and comprising:

(a) a frame including:

(i) a rear roller mounting assembly for two rear rollers;
(ii) a front roller mounting assembly for a front roller; and
(iii) a central bridge assembly connecting said front roller mounting assembly to said rear roller mounting assembly;

(b) two rear rollers mounted in said rear roller mounting assembly, and a front roller mounted in said front roller mounting assembly, each of said rollers having an axis of rotation, and wherein all of said axes of rotation are parallel to one another; and (c) a first support assembly, located about said axes of rotation of said rear rollers and able to support said rear roller mounting assembly above an upwardly facing surface;

(d) a second support assembly, located about said axis of rotation of said front roller and able to support said front roller mounting assembly above the upwardly facing surface; and (e) wherein when said device is in use said first and second support assemblies support said rear and front roller mounting assemblies and weight said rear and front roller mounting assemblies are supporting, above the upwardly facing surface, leaving said central bridge assembly substantially free of vertical structural stress; and (f) wherein said first support assembly comprises a wheel mounted on an axle attached to said frame and substantially aligned to one of said axes of said rear rollers, so that said wheel has an axis of rotation that is parallel to said axes of rotation of said rear rollers.

3. A bicycle rollers device, having a front and a back and comprising:

(a) a frame including:
(i) a rear roller mounting assembly for two rear rollers;
(ii) a front roller mounting assembly for a front roller; and
(iii) a central bridge assembly connecting said front roller mounting assembly to said rear roller mounting assembly;

(b) two rear rollers mounted in said rear roller mounting assembly, and a front roller mounted in said front roller mounting assembly;

(c) a set of wheels mounted on said frame so as to support said rollers above a surface upon which said wheels are set, said wheels permitting forward and rearward motion of said frame; and (d) a motion-resisting assembly, including:
(i) wherein one of said set of wheels is a motion-resisting wheel, having an axis of rotation and a wheel attachment element displaced from said axis of rotation;
(ii) a device attachment element on said device; and
(iii) an elastic tension member, attached to said device attachment element and said wheel attachment element, wherein said motion-resisting wheel has a centered position in which said elastic tension member is at its shortest and wherein when said motion-resisting wheel rotates from said centered position said elastic tension member urges said motion-resisting wheel toward its centered position.

4. The device of claim 3, wherein said wheel attachment element is a post attached to said motion-resisting wheel, and said elastic tension member is an elastic loop, that is looped over said post.

5. The device of claim 4, wherein said post terminates in a knob that retains said elastic tension member on said post.

6. The device of claim 4, wherein said motion-resisting wheel has a circumference and said post is attached to said motion-resisting wheel by way of a rigid element attached to said motion-resisting wheel, so that said post protrudes past said wheel circumference.

7. The device of claim 3, wherein said device attachment element is a stationary axle for one of said wheels.

8. The device of claim 3, further being divided into segments that are connected together by hinges, so that said device can be folded into a compact state, and wherein said device attachment element and said motion-resisting wheel are positioned on a single one of said segments, so that said device can be folded without releasing tension on said elastic tension member.

9. The device of claim 8, wherein said motion-resisting wheel and said device attachment element are both positioned on said rear roller mounting assembly, which is hinged to said central bridge assembly.

10. The device of claim 3, wherein said elastic tension member is made of polyurethane.

11. The device of claim 3, wherein said elastic tension member acts as a damped spring.

* * * * *